US008910728B2

(12) United States Patent
Okuda

(10) Patent No.: US 8,910,728 B2
(45) Date of Patent: Dec. 16, 2014

(54) ELECTRIC POWER TOOL

(75) Inventor: Shinsuke Okuda, Anjo (JP)

(73) Assignee: Makita Corporation, Anjo-Shi (JP)

( * ) Notice: Subject to any disclaimer, the term of this patent is extended or adjusted under 35 U.S.C. 154(b) by 655 days.

(21) Appl. No.: 13/180,026

(22) Filed: Jul. 11, 2011

(65) Prior Publication Data

US 2012/0043102 A1 Feb. 23, 2012

(30) Foreign Application Priority Data

Aug. 20, 2010 (JP) ..... 2010-185347

(51) Int. Cl.
*B27F 5/02* (2006.01)
*B25F 5/02* (2006.01)

(52) U.S. Cl.
CPC ..... *B25F 5/02* (2013.01)
USPC ..... 173/93.5; 173/217; 173/171; 227/130; 227/156; D8/68

(58) Field of Classification Search
USPC ..... 227/120, 130, 156; D8/61–70; 173/93, 173/93.5, 104, 114, 132, 171, 217; 81/57.11, 429, 454, 469; 408/20, 124, 408/234, 241 R
See application file for complete search history.

(56) References Cited

U.S. PATENT DOCUMENTS

| | | | | |
|---|---|---|---|---|
| 2,207,269 | A * | 7/1940 | Schiff | 30/34.05 |
| 5,025,970 | A * | 6/1991 | Anderson et al. | 227/156 |
| 5,992,540 | A * | 11/1999 | Smolinski et al. | 173/169 |
| 7,108,079 | B2 * | 9/2006 | Sakai et al. | 173/217 |
| 7,140,451 | B2 * | 11/2006 | Yoshimizu et al. | 173/217 |
| D534,779 | S * | 1/2007 | Tsai et al. | D8/68 |
| D560,990 | S * | 2/2008 | Aglassinger | D8/68 |
| D565,375 | S * | 4/2008 | Shi | D8/68 |
| D628,038 | S * | 11/2010 | Aoki et al. | D8/68 |
| D656,804 | S * | 4/2012 | Murray | D8/68 |
| 8,167,056 | B2 * | 5/2012 | Ito et al. | 173/171 |
| 8,607,893 | B2 * | 12/2013 | Kumagai et al. | 173/210 |
| 2002/0170185 | A1 | 11/2002 | Kondo et al. | |
| 2004/0011544 | A1 * | 1/2004 | Cooper et al. | 173/217 |
| 2004/0111933 | A1 | 6/2004 | Yoshimizu et al. | |
| 2007/0056760 | A1 * | 3/2007 | Yoshimizu et al. | 173/217 |
| 2010/0038103 | A1 * | 2/2010 | Ueda et al. | 173/46 |

FOREIGN PATENT DOCUMENTS

| | | | |
|---|---|---|---|
| DE | 20 2005 018 772 | U1 | 4/2006 |
| EP | 1 382 421 | A2 | 1/2004 |
| EP | 1 872 900 | A2 | 1/2008 |
| GB | 1 252 821 | A | 11/1971 |
| JP | A-2009-220272 | | 10/2009 |
| WO | WO 2008/133339 | A1 | 11/2008 |

OTHER PUBLICATIONS

Feb. 24, 2014 Search Report issued in European Patent Application No. 11176556.6.

* cited by examiner

*Primary Examiner* — Scott A. Smith
(74) *Attorney, Agent, or Firm* — Oliff PLC

(57) ABSTRACT

In an electric power tool in which a metal front housing that accommodates a driving mechanism is assembled to the front of a main housing that accommodates a motor, an output shaft is protruded from the distal end of the front housing, and the outer periphery of the front housing is protected by a cylindrical transparent cover made of synthetic resin, a decorative pattern is formed on the inner surface of the transparent cover. The decorative pattern is formed of bumps and dips formed on the inner surface.

12 Claims, 5 Drawing Sheets

ELECTRIC POWER TOOL

BACKGROUND OF THE INVENTION

This application claims the entire benefit of Japanese Patent Application Number 2010-185347 filed on Aug. 20, 2010, the entirety of which is incorporated by reference.

TECHNICAL FIELD

The present invention relates to an electric power tool in which a metal front housing that accommodates a driving mechanism is assembled to the front of a main housing that accommodates a motor and the outer periphery of the front housing is protected by a cylindrical transparent cover made of synthetic resin.

BACKFROUND ART

Japanese Patent Application Publication No. 2009-220272 (JP-A-2009-220272) describes an electric power tool that prevents a resin cover from being detached from a hammer case that accommodates a striking mechanism in such a manner that the cover is attached around the hammer case and an elastic stopper is engaged with the hammer case on the front side of the cover. In the electric power tool described in JP-A-2009-220272, even when the temperature of the aluminum hammer case increases because of heat generated by the striking mechanism, or the like, the cover is able to prevent a worker from directly touching the hammer case. Therefore, by suppressing a worker's discomfort due to heat, it is possible to suppress a decrease in workability.

Incidentally, the above electric power tool has a limited decorative portion, so it is not easy to accentuate its decorativeness. For this reason, an existing electric power tool has a poor appearance, and may not have a good decorativeness.

SUMMARY OF THE INVENTION

The present invention provides an electric power tool that has a high decorativeness.

A first aspect of the present invention provides an electric power tool including a main housing that accommodates a motor, a metal front housing that is assembled to a front of the main housing and that accommodates a driving mechanism, an output shaft that protrudes from a distal end of the front housing, and a cylindrical transparent cover that protects an outer periphery of the front housing and that is made of synthetic resin, wherein a decorative pattern is formed on an inner surface of the transparent cover.

A second aspect of the present invention provides such a feature that, in the first aspect, the decorative pattern is formed of bumps and dips on the inner surface.

With the electric power tool according to the first aspect of the present invention, the decorative pattern can be seen through an outer side of the transparent cover. Thus, the decorative pattern improves the appearance of the electric power tool to enhance the decorativeness of the electric power tool.

According to the second aspect of the present invention, a sense of depth is enhanced by the bumps and dips, so the decoration of the electric power tool becomes novel.

DETAILED DESCRIPTION OF THE PREFERRED EMBODIMENTS

Figure 1:
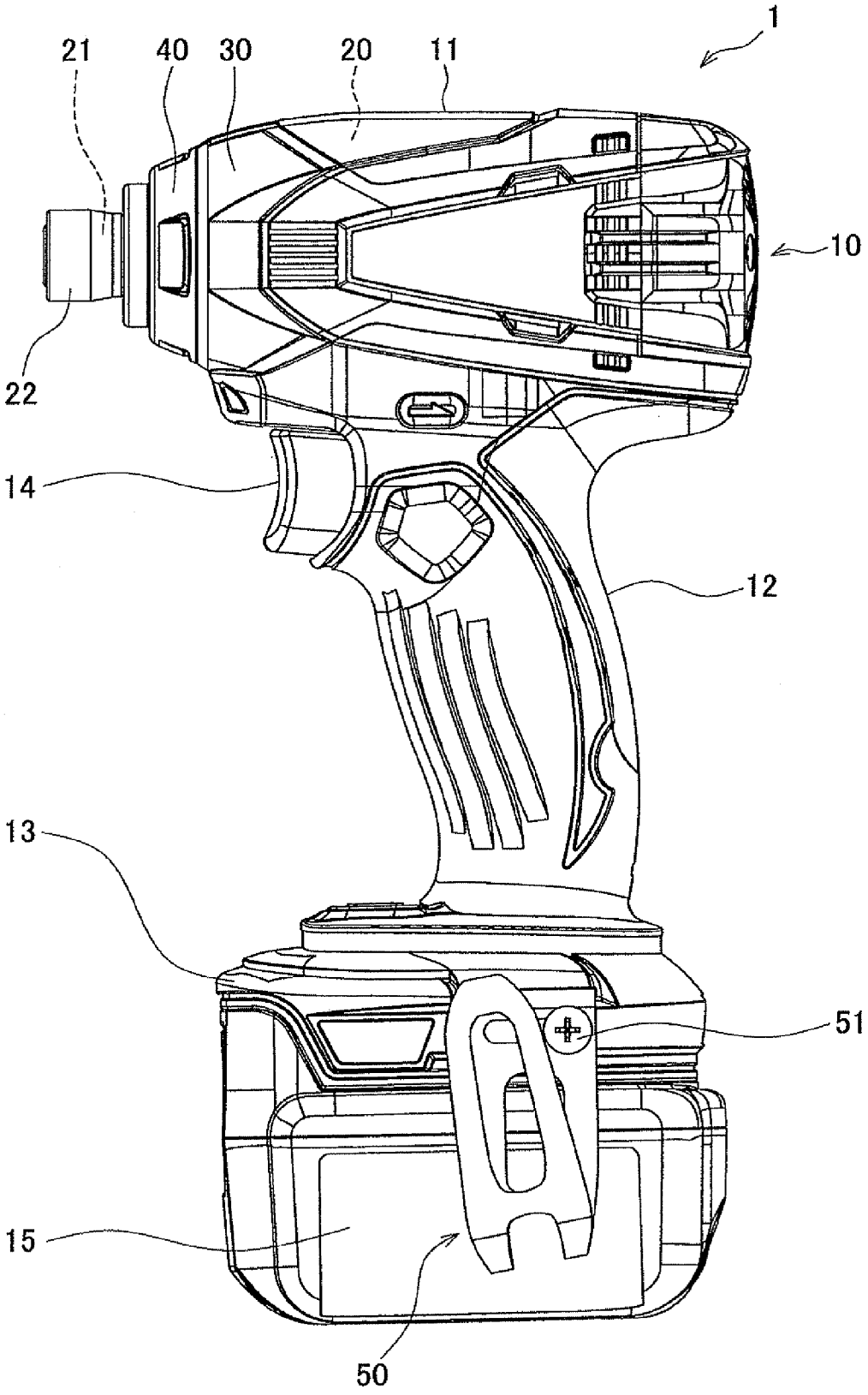
FIG. 1 is a side view of an impact driver according to a first embodiment of the present invention.

A first embodiment of the present invention will be described with reference to FIG. 1 to FIG. 2D. An impact driver 1 shown in FIG. 1 includes a main housing 10, a hammer case 20, a cover 30, a bumper 40 and a hook 50.

The main housing 10 is formed by assembling right and left half housings made of resin. The main housing 10 has a body portion 11, a handle portion 12 and a battery pack loading portion 13. The body portion 11 is formed in a cylindrical shape and extends in the front-rear direction (horizontal direction in FIG. 1) of the impact driver 1. A motor (not shown) is accommodated inside the body portion 11.

As shown in FIG. 1, the handle portion 12 is continuously provided from the body portion 11 so as to form a substantially T shape in side view of the impact driver 1. A switch (not shown) having a trigger 14 is accommodated inside the handle portion 12. A battery pack 15 is detachably loaded at the battery pack loading portion 13. The battery pack 15 feeds power to the motor. Note that the impact driver 1 is an example of the electric power tool according to the aspect of the present invention.

The hammer case 20 is made of metal (for example, aluminum), and is assembled to the front (left side in FIG. 1) of the body portion 11. A striking mechanism (not shown) and an anvil 21 are accommodated inside the hammer case 20. The anvil 21 protrudes from the distal end surface of the hammer case 20. The anvil 21 is rotatably supported inside the hammer case 20 by a bearing. A chuck 22 is provided at the distal end of the anvil 21. A distal end tool may be attached to the chuck 22. The striking mechanism converts rotation of the motor to rotational striking force and then transmits the rotational striking force to the distal end tool. Note that the hammer case 20 is an example of the front housing according to the aspect of the present invention, the anvil 21 is an example of the output shaft according to the aspect of the present invention, and the striking mechanism is an example of the driving mechanism according to the aspect of the present invention.

The cover 30 is made of a transparent synthetic resin and is formed in a cylindrical shape. The cover 30 is attached to a portion, from which the hammer case is exposed through the body portion 11, on the front outer periphery of the hammer case 20. As will be described later, decorative patterns are formed on the inner surface of the cover 30. The bumper 40 is made of synthetic rubber and is formed in a ring shape. The bumper 40 is assembled to the front end of the cover 30, and is attached to the exposed portion. In a state where the bumper 40 is assembled to the front end of the cover 30, the outer peripheral surface of the bumper 40 is continuous with the outer peripheral surface of the cover 30, and the cover 30 and the bumper 40 prevent the front outer periphery of the hammer case 20 from being exposed. By so doing, the cover 30 and the bumper 40 protect the front outer periphery. Note that the cover 30 is an example of the transparent cover according to the aspect of the present invention.

The hook 50 is attached to the right side surface (in front view of the impact driver 1) of the battery pack loading portion 13 using a screw 51. The hook 50 is formed by bending a metal plate into a substantially U shape in front view and rear view of the impact driver 1. The hook 50 allows the impact driver 1 to be suspended from a worker's belt.

FIG. 2A to FIG. 2D show examples in which a decorative pattern is formed on the inner surface of the cover 30. In the present embodiment, a plurality of decorative lines are formed in each of an upper left corner region R1, an upper right corner region R2, a lower left corner region R3 and a lower right corner region R4 of the inner peripheral surface of the cover 30. These decorative lines extend in the front-rear direction (axial direction) of the cover 30. The decorative lines are spaced apart from each other at predetermined intervals in the circumferential direction of the cover 30.

Figure 2A:
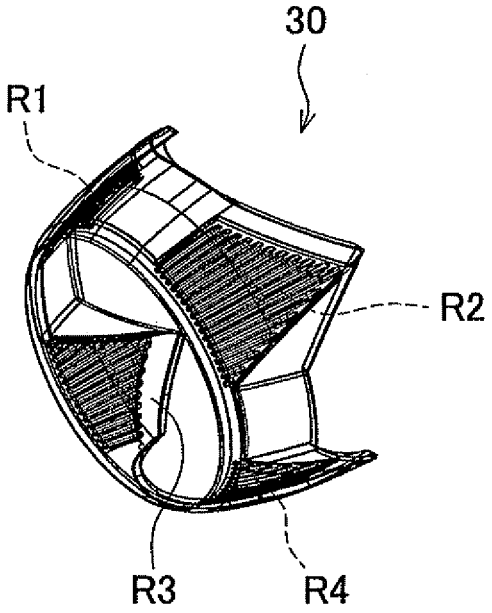
FIG. 2A is an overall perspective view of a cover according to the first embodiment.
Figure 2B:
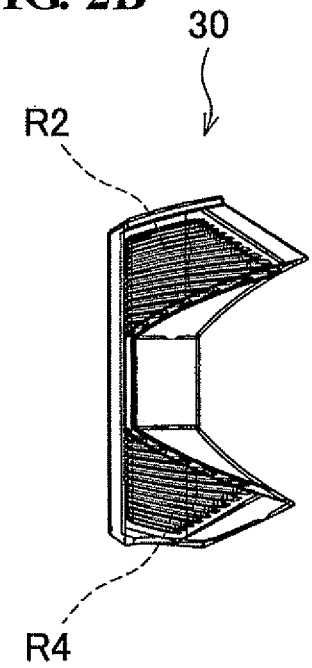
FIG. 2B is a side view of the cover.
Figure 2C:
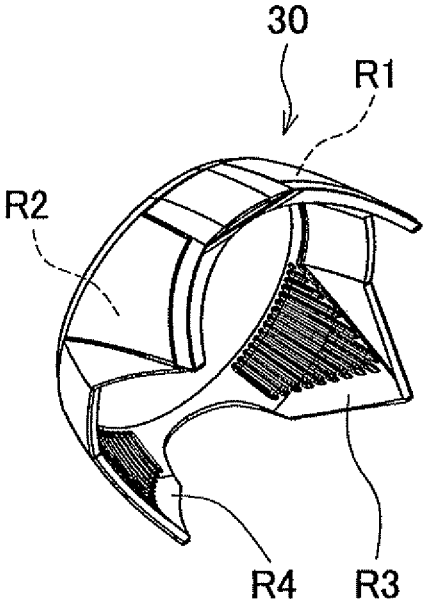
FIG. 2C is a view that shows a state where decorative patterns are formed on the inner surface of the cover.
Figure 2D:
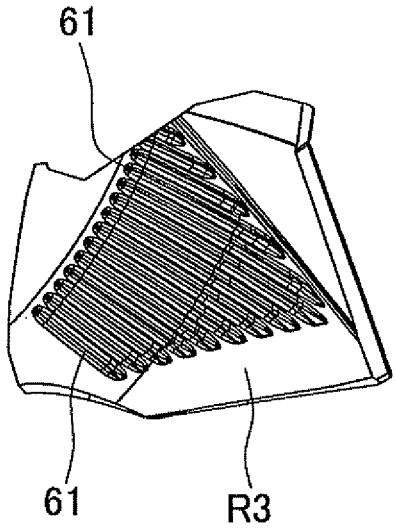
FIG. 2D is a partially enlarged view of FIG. 2C.

As shown in FIG. 2D, the decorative lines are formed of rib-like protrusions 61, so that bumps and dips can be provided in each of the regions R1 to R4 as the decorative patterns. In the present embodiment, the decorative patterns are provided on the molding surface of a molding die, and then, when the cover 30 is molded using the molding die, the protrusions 61 are formed in each of the regions R1 to R4. Because the cover 30 is transparent, when the cover 30 is viewed from the outer side, the decorative patterns (bums and dips) can be seen through the outer side as shown in FIG. 2A and FIG. 2B.

In the impact driver 1 according to the first embodiment, as described above, when the cover 30 is viewed from the outer side, the decorative patterns can be seen through the outer side. Thus, the decorative patterns improve the appearance of the impact driver 1 to enhance the decorativeness of the impact driver 1.

In addition, the bumps and dips are provided as the decorative patterns to enhance a sense of depth, so the decoration of the impact driver 1 becomes novel.

A second embodiment of the present invention will be described with reference to FIG. 3A to FIG. 3D. Here, the description of the same components to those of the first embodiment is omitted. A cover 30A can be attached to the impact driver 1 (see FIG. 1) instead of the cover 30 according to the first embodiment. A plurality of decorative lines are formed in each of an upper left corner region R11, an upper right corner region R12, a lower left corner region R13 and a lower right corner region R14 of the inner peripheral surface of the cover 30A. These decorative lines extend in the front-rear direction of the cover 30A as in the case of the first embodiment.

Figure 3A:
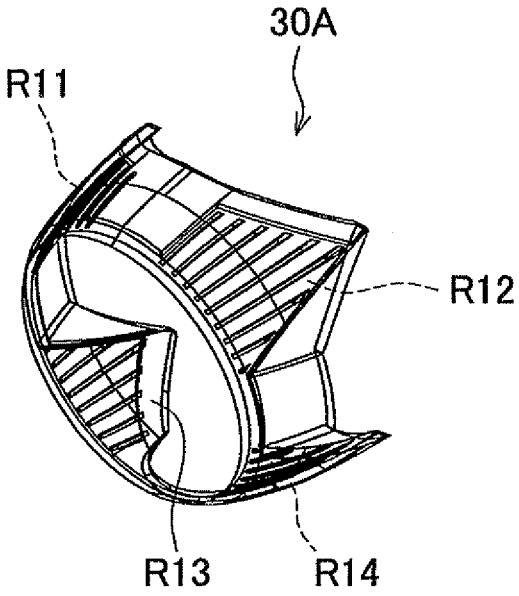
FIG. 3A is an overall perspective view of a cover according to a second embodiment.
Figure 3B:
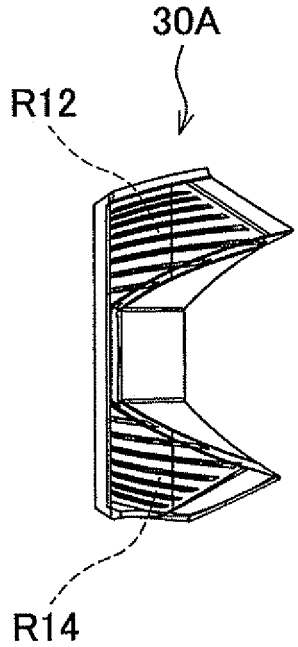
FIG. 3B is a side view of the cover.
Figure 3C:
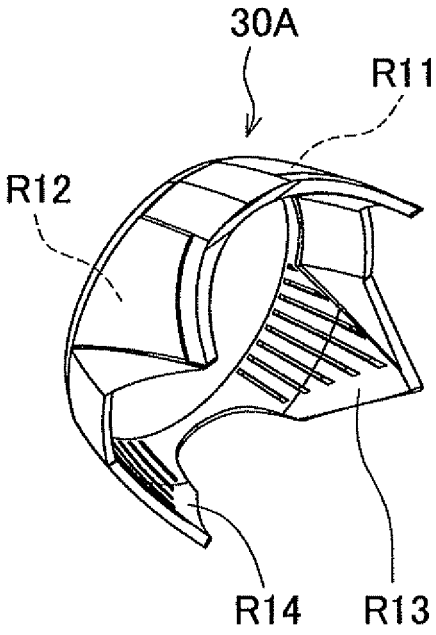
FIG. 3C is a view that shows a state where decorative patterns are formed on the inner surface of the cover.
Figure 3D:
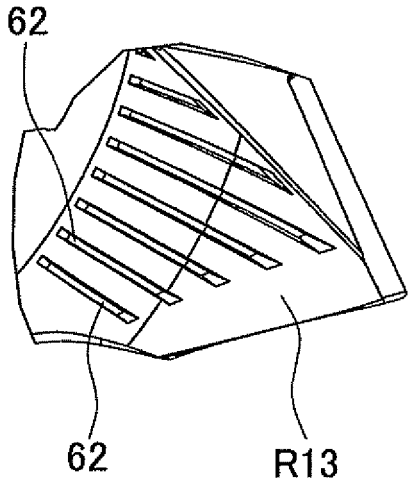
FIG. 3D is a partially enlarged view of FIG. 3C.

In the present embodiment, different from the first embodiment, the height of protrusion of each of rib-like protrusions 62 is reduced to a degree to which the presence of the decorative lines may be recognized as compared with the height of protrusion of each of the protrusions 61 according to the first embodiment. In addition, the interval between the adjacent protrusions 62 (decorative lines) is wider than the interval between the adjacent protrusions 61 (decorative lines). Therefore, the decorative patterns (bumps and dips) different from those of the first embodiment can be formed in the regions R11 to R14. In the present embodiment as well, as shown in FIG. 3A and FIG. 3B, the decorative patterns (bumps and dips) can be seen through the outer side of the cover 30A.

In the second embodiment, the bumps and dips different from those of the first embodiment are provided as the decorative patterns to enhance a sense of depth different from that of the first embodiment, so the decoration of the impact driver 1 may be made novel.

A third embodiment of the present invention will be described with reference to FIG. 4A to FIG. 4D. Here, the description of the same components to those of the first and second embodiments is omitted. A cover 30B may also be attached to the impact driver 1 as in the case of that of the second embodiment. A plurality of decorative lines are formed in each of an upper left corner region R21, an upper right corner region R22, a lower left corner region R23 and a lower right corner region R24 of the inner peripheral surface of the cover 303. These decorative lines extend in the circumferential direction of the cover 30B, different from those of the first and second embodiments.

Figure 4A:
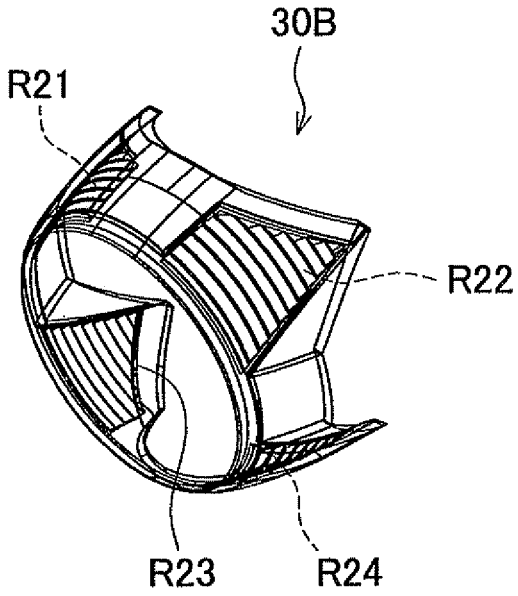
FIG. 4A is an overall perspective view of a cover according to a third embodiment.
Figure 4B:
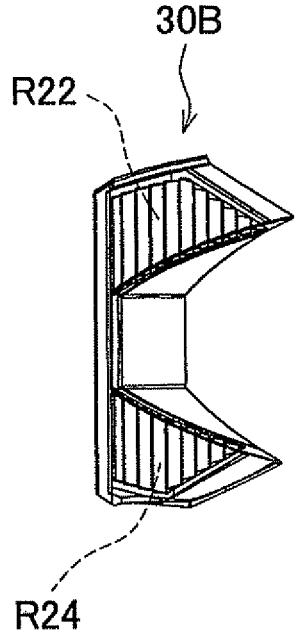
FIG. 4B is a side view of the cover.
Figure 4C:
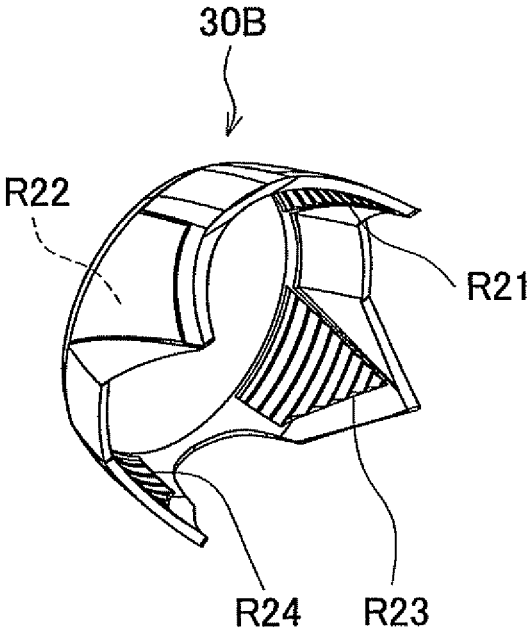
FIG. 4C is a view that shows a state where decorative patterns are formed on the inner surface of the cover.
Figure 4D:
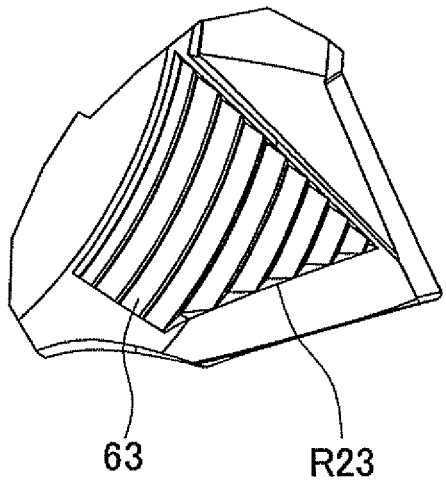
FIG. 4D is a partially enlarged view of FIG. 4C.
Figure 5A:
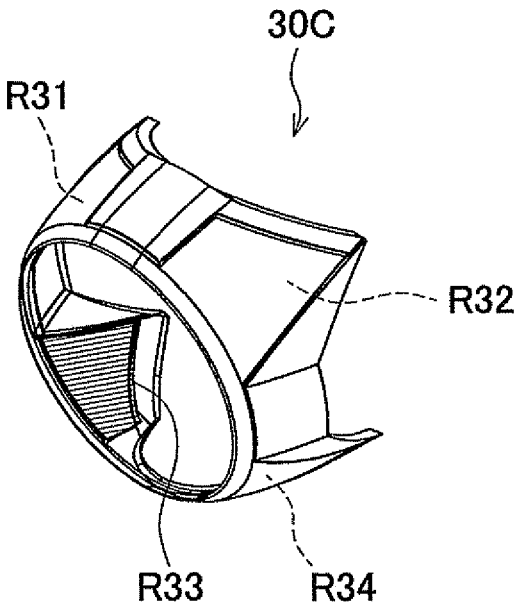
FIG. 5A is an overall perspective view of a cover according to a fourth embodiment.
Figure 5B:
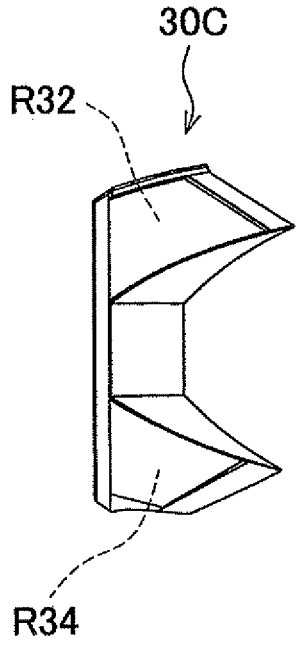
FIG. 5B is a side view of the cover.
Figure 5C:
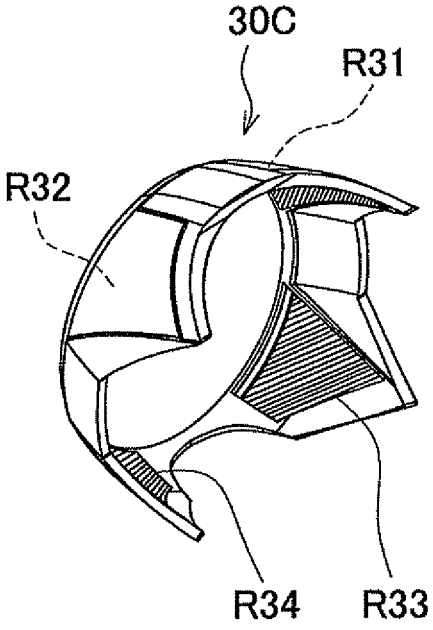
FIG. 5C is a view that shows a state where decorative patterns are formed on the inner surface of the cover.
Figure 5D:
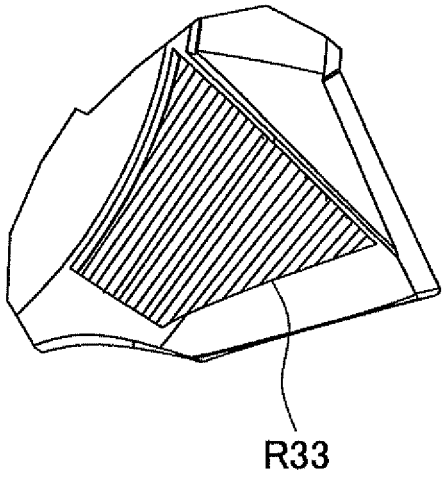
FIG. 5D is a partially enlarged view of FIG. 5C.

In the present embodiment, as shown in FIG. 4D, each decorative line is formed of a protrusion 63 that is inclined upward so that the height of the protrusion at the rear portion of the cover 30B is higher than the height of the protrusion at the front portion of the cover 30B. Furthermore, the decorative lines are provided adjacent to each other in the front-rear direction of the cover 30B. In the present embodiment as well, as in the case of the first and second embodiments, when the cover 30B is molded, the protrusions 63 can be formed in each of the regions R21 to R24. As shown in FIG. 4A and FIG. 4B, the decorative patterns (bumps and dips) formed of the plurality of protrusions 63 can be seen through the outer side of the cover 30B.

In the third embodiment, different from the first and second embodiments, the direction in which the decorative lines extend is set in the circumferential direction of the cover 30B to enhance a sense of depth different from those of the first and second embodiments, so the decoration of the impact driver 1 may be made further novel.

A fourth embodiment of the present invention will be described with reference to FIG. 5A to FIG. 5D. Here, the description of the same components to those of the first to third embodiments is omitted. A cover 30C can also be attached to the impact driver 1 as in the case of those of the second and third embodiments. Fine bump and dip patterns (grain patterns) are formed in each of an upper left corner region R31, an upper right corner region R32, a lower left corner region R33 and a lower right corner region R34 of the inner peripheral surface of the cover 30C. In FIG. 5A to FIG. 5D, the bump and dip patterns are shown by oblique lines.

In the present embodiment, when the cover 30C is molded using a molding die in which bumps and dips are formed, a grain pattern can be formed in each of the regions R31 to R34. In the present embodiment as well, the grain patterns can be seen through the outer side of the cover 30C.

In the fourth embodiment, tiny bumps and dips are repeated by the grain patterns to provide a sense that the decorative patterns are raised, so a sense of depth may be provided. In addition, different from the first to third embodiments, the decorative patterns are formed of tiny bumps and dips, so the decoration of the impact driver 1 is made further novel.

The aspect of the present invention is not limited to the above described embodiments; part of the components may be appropriately modified without departing from the scope of the present invention. For example, as in the case of the first and second embodiments, when the decorative patterns are formed of the decorative lines, the number of the decorative lines, the interval of the adjacent decorative lines and the height of protrusion of each rib-like protrusion may be changed to appropriate ones different from those of the first and second embodiments.

In addition, as in the case of the above described third embodiment, when the decorative lines are formed of the upward-inclined protrusions 63, the angle of upward inclination may be appropriately changed. Furthermore, different from the third embodiment, each decorative line may be formed of a protrusion that is inclined downward so that the height of the protrusion at the rear portion of the cover 30B is lower than the height of the protrusion at the front portion of the cover 30B.

In addition, in the above described first to fourth embodiments, the decorative patterns are formed in each of the upper and lower left corner regions and upper and lower right corner regions of the inner peripheral surface of the cover; instead, the decorative patterns may be formed over all around the inner surface of the cover. Furthermore, the decorative pattern may be an appropriate combination of the bumps and dips according to the first to fourth embodiments. In addition, a paint may be applied onto the recesses or protrusions of the bumps and dips to be colored or the bumps and dips may be formed of metal plating. Furthermore, different from the first to fourth embodiments, without providing the bumper 40, a cover may be attached to a portion, exposed through the body portion 11, on the front outer periphery of the hammer case 20.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. An electric power tool comprising:

a main housing that accommodates a motor;

a metal front housing that is assembled to a front of the main housing and that accommodates a driving mechanism;

an output shaft that protrudes from a distal end of the front housing; and a cylindrical transparent cover that protects an outer periphery of the front housing and that is made of synthetic resin, wherein a plurality of decorative patterns are formed on an inner surface of the transparent cover, each of the plurality of decorative patterns being separated from other decorative patterns, each of the plurality of decorative patterns being formed by a plurality of decorative lines.

2. The electric power tool according to claim 1, wherein the plurality of decorative patterns are formed of bumps and dips on the inner surface.

3. The electric power tool according to claim 2, wherein the bumps and dips are formed of the plurality of decorative lines that extend in a front-rear direction of the transparent cover at a predetermined interval in a circumferential direction of the transparent cover.

4. The electric power tool according to claim 3, wherein the decorative lines are each formed of a rib-like protrusion.

5. The electric power tool according to claim 2, wherein the bumps and dips are formed of the plurality of decorative lines that are adjacent to each other in a front-rear direction of the transparent cover and that extend in a circumferential direction of the transparent cover.

6. The electric power tool according to claim 5, wherein the decorative lines are each formed of a protrusion that is inclined upward so that a height of the protrusion at a rear portion of the transparent cover is higher than a height of the protrusion at a front portion of the transparent cover.

7. The electric power tool according to claim 5, wherein the decorative lines are each formed of a protrusion that is inclined downward so that the height of the protrusion at the rear portion of the transparent cover is lower than the height of the protrusion at the front portion of the transparent cover.

8. The electric power tool according to claim 2, wherein the bumps and dips are formed of a grain pattern.

9. The electric power tool according to claim 2, wherein the decorative pattern is formed in each of upper and lower left corner regions and upper and lower right corner regions of an inner peripheral surface of the transparent cover.

10. The electric power tool according to claim 2, wherein the decorative patterns are formed over a whole inner peripheral surface of the transparent cover.

11. The electric power tool according to claim 1, wherein the decorative pattern is formed in each of upper and lower left corner regions and upper and lower right corner regions of an inner peripheral surface of the transparent cover.

12. The electric power tool according to claim 1, wherein the decorative patterns are formed over a whole inner peripheral surface of the transparent cover.

* * * * *